United States Patent [19]

Christensen

[11] 4,104,107

[45] Aug. 1, 1978

[54] APPARATUS FOR URGING WEB GUIDES TOWARD THE CORRUGATING ROLL OF A SINGLE FACER

[75] Inventor: Kenneth Kaae Christensen, Winfield, Ill.

[73] Assignee: Koppers Company, Inc., Pittsburgh, Pa.

[21] Appl. No.: 778,881

[22] Filed: Mar. 18, 1977

[51] Int. Cl.[2] ..... B31F 1/00

[52] U.S. Cl. ..... 156/473

[58] Field of Search ..... 156/470–473, 156/205–208, 210

[56] References Cited

U.S. PATENT DOCUMENTS

| | | | |
|---|---|---|---|
| 3,484,320 | 12/1969 | David | 156/473 |
| 3,951,725 | 4/1976 | Bradley | 156/473 |
| 4,038,130 | 7/1977 | Cosby | 156/473 |

*Primary Examiner*—David A. Simmons

*Attorney, Agent, or Firm*—Thomas L. Sivak; Oscar B. Brumback

[57] ABSTRACT

In a machine for the manufacture of corrugated paper, apparatus is described for resiliently biasing the web guide means against the rolls of the corrugator as the corrugated web passes around the roll. In such apparatus a pair of spaced link bars are pivotally attached to a plate that is supported by the corrugator; the link bars also being pivotally connected to the guide means to provide a planar linkage. A ram attached to the plate and to one of the link bars resiliently urges the guide means toward the roll.

3 Claims, 1 Drawing Figure

Fig. I.
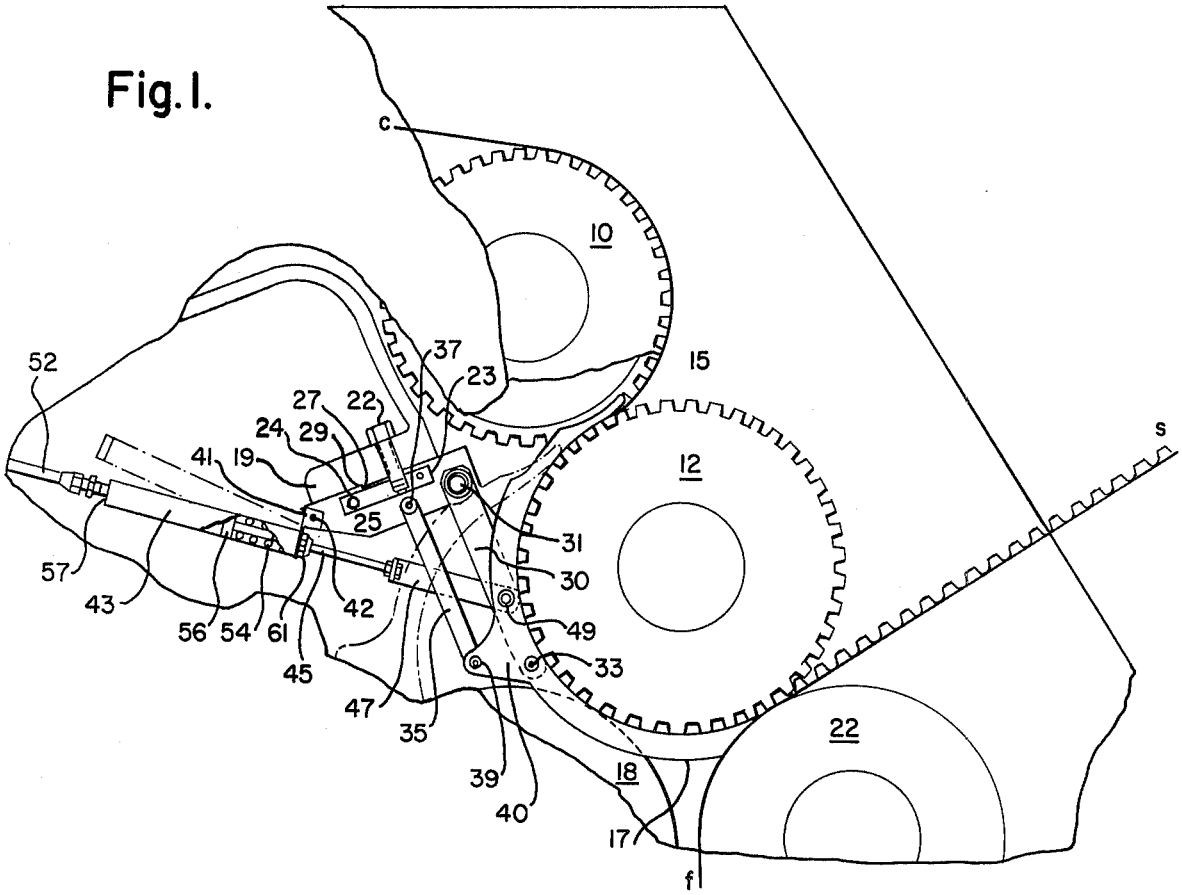

APPARATUS FOR URGING WEB GUIDES TOWARD THE CORRUGATING ROLL OF A SINGLE FACER

CROSS-REFERENCES TO RELATED APPLICATIONS

This invention is related to application Ser. No. 596,407 filed on July 16, 1975, by James L. Cosby and Gordon L. Morgret entitled "Corrugating Machine Having Self-Adjusting Web Guides", now U.S. Pat. No. 4,038,130 and assigned to the assignee of the present invention, in that the aforementioned application describes apparatus for resiliently biasing the web guides.

BACKGROUND OF THE INVENTION

1. Field of the Invention

This invention relates generally to a single facer machine and, more particularly, to apparatus for the self-adjustment of the web guides that hold a corrugated medium web against the corrugator roll in a single-facer.

2. Description of the Prior Art

In the manufacture of corrugated board, the corrugated interliner is made by passing the web of paperboard material of the proper temperature and moisture content through the nip of a pair of coacting corrugating rolls having intermeshing splines running axially the length of the rolls. Conventionally, the web of paperboard passes partially around one roll, through the nip between the intermeshing spline teeth of the rolls where the web of paperboard material is deformed to the shape of the intermeshing teeth (corrugations or flutes are formed on the web), and then travels partially around the second corrugating roll. An adhesive roll parallel to and adjacent to the second roll applies adhesive to the tips of the flutes of the corrugated web. A pressure roll parallel to and adjacent to the second corrugating roll carries a smooth web of facing material and presses the facing web against the tips of the flutes having the adhesive thereon. The structure of an adhering smooth web and corrugated web is commonly called single faced paperboard.

If the corrugated web becomes disengaged from the second roll too early, malformations of the flutes may occur and these can reduce the quality of the corrugated paperboard being made. Guide means are conventionally used to hold the hot web closely to the second corrugating roll. These guide means are comprised of a plurality of thin crescent shaped strips of metal of an inner arc of a size substantially to fit around an arc of the second corrugating roll with minimal clearance and to extend from a head of the nip of the rolls to a point where the corrugated web comes in contact with the pressure roll. These guide means are generally spaced along the length of the roll from two to four inches apart. Conventionally, these guides are fixably held in place by means of rigid supports that are bolted to the structural members of the machine. Patent application Ser. No. 596,407 shows an improvement wherein the guide means are biased against the second corrugating roll, thereby permitting the guide means to adapt automatically and uniformly to different thicknesses and possible irregularities in the web.

SUMMARY OF THE INVENTION

In accordance with this invention a plate rests on a supporting bar attached to the structure of a machine for making corrugated board. Web guide means are attached to the plate by way of planar linkage for limited movement in a single plane. A fluid actuated ram attached to the plate and the linkage resiliently biases the guide means toward the corrugating roll of the machine.

BRIEF DESCRIPTION OF THE DRAWING

The FIGURE is an elevational view of a single-facer station of a machine for making corrugated board.

DETAILED DESCRIPTION

In a typical single-facer station, FIG. 1, a heated and moistened web of a corrugating medium (*c*) travels over the first corrugating roll 10 and through the intermeshing engagement of the first roll 10 and the second roll 12 at nip 15. In the nip 15 the medium becomes corrugated. Upon emerging from nip 15, the medium is stripped from the upper roll 10 by guide means 17 and held against the fluted surface of the second roll 12. The corrugated medium travels around the arc of the second corrugating roll 12 and a layer of adhesive of a controlled thickness is applied to the flutes of the corrugated medium by a glue roll 18.

A web of facing material (*f*) is carried around the pressure roll 22 and is pressed into contact with the adhesive-coated flutes of the corrugating medium (*c*) to form the single-faced board (*s*) that leaves the machine.

As explained above, it is essential that the corrugated web (*c*) remain in close contact with the second corrugator roll. Maintaining this contact is the function of the guide means 17. It will be understood that a plurality of such guide means are provided along the length of the second corrugating roll 12. A support 19, conventionally a part of the single-facer, is provided for the guide means 17. Normally, the guide means 17 are fixedly secured to the member 19.

From a directional point of view, it will also be evident that the individual guide means are spaced horizontally along the length of the roll and that the crescent shaped members extend in a vertical arc.

In accordance with this invention there is presented an arrangement for biasing the guide means toward the roll with a predetermined biasing force. A bar 23 is attached to support 19 along the length of the support by a suitable means such as, for example, illustrated by bolts 22. Bolts 22 extend through support 19 and are threaded into the bar 23. A pair of plates 25 are secured to each side of bar 23 by means of screws 24. Bars 23 can be spaced along member 19 to provide support for plates 25. An abutment 27 on the plate coacts with abutment 29 on member 19 to fix the position of plate 25.

A support link 30 rotably connected to plate 25 by pivot 31 and to guide means 17 by pivot 33 extends between plates 25 and guide means 17 to support the guide means. Another link 35 is rotably connected by way of pivot 37 to plate 25 and by way of pivot 39 to a lug 40 which projects radially from guide means 17. Clearance exists between lug 40 of guide 17 and pivot 39 to permit guide 17 to center itself with respect to roll 12. Links 30 and 35 oscillate above pivots 31 and 37. Thus links 30 and 35 with spaced pivots 31, 33, 37, and 39 constitute a planar linkage to restrain the oscillation of pivots 33 and 39 relative to the fixed pivots 31 and 37 to movement in a single plane. The planar linkage described maintains the upper tip of guide means 17 in the groove of upper roll 10 and the lower section of guide means 17 in the groove of glue roll 18, when roll 18 is rotated away from second roll 12.

To bias the guide means 17 toward roll 12, a conventional ram 43 is provided. The shaft 45 of ram 43 is rotably connected by a bar 47 to link 30 by way of pivot pin 49. The pneumatic force, air-under-pressure is supplied to pneumatic ram 43 by way of a conventional line 52. A compression spring 54 biases the plunger 56 toward end 57. Air acting on plunger 56 overcomes the biasing force of the spring 54 to urge the guide means 17 towards the roll 12.

The ram 43 is rotably suspended from plate 25 by a hanger 41 which, by way of pivot 42, is connected to plate 25. The ram shaft 45 extends through hanger 41 and ram 43 is attached to the hanger by nut 61.

In operation, air under pressure is applied through line 52 to force piston 56 to the right (as illustrated) against spring 54 to urge guide means 17 against the second roll 12. The corrugated medium (*c*) passes between roll 12 and guide means 17. As the thickness of the corrugated medium increases, the guide is urged to the left and against the yielding pressure of the air in the cylinder of ram 43. While slight oscillations may occur due to change in thickness of the corrugated medium, the pressure keeping the medium closely bound to the roll 12 does not diminish.

From the foregoing, it can be seen that pressure is applied to corrugated medium *c* at laterally spaced locations along the width of the roll 12, such pressure being yieldably applied at each location to compensate for irregularities in the medium. Accordingly, the invention has been described in its best embodiment and mode of operation.

What is claimed is:

1. Apparatus for resiliently urging the web guide means of a single facer station of a machine for making corrugated board toward the corrugating rolls so as to maintain the contact of the web of corrugated medium with the corrugating rolls, comprising:

(a) plate means;

(b) means for fixably supporting said plates on said machine;

(c) a planar linkage connecting said guide means and said plates comprising (i) a pair of spaced bars, (ii) first pivot means connecting said bars and said plates, and (iii) second pivot means connecting said web guide and said bars whereby oscillation of said guide means is constrained within a predetermined plane, (d) pneumatic ram means;

(e) a hanger connecting said ram and said plate; and (f) a pivot connecting said ram and one of said bars whereby said ram resiliently urges said guide means toward said roll to maintain the contact of said web with said corrugated roll.

2. The apparatus of claim 1 wherein said first and second pivot means are adapted to maintain said guide means within the groove formed by the corrugating rolls of a single facer station when the glue roll is retracted from its operational position with said corrugating rolls.

3. The apparatus of claim 1 wherein said second pivot means is adapted to cause self-centering of said guide means with said corrugating rolls.

* * * * *